US011725856B2

(12) United States Patent
Stubkier et al.

(10) Patent No.: US 11,725,856 B2
(45) Date of Patent: Aug. 15, 2023

(54) REFRIGERANT PROCESSING UNIT, A METHOD FOR EVAPORATING A REFRIGERANT AND USE OF A REFRIGERANT PROCESSING UNIT

(71) Applicant: Johnson Controls Denmark ApS, Højbjerg (DK)

(72) Inventors: Simon Stubkier, Silkeborg (DK); Per Skov, Mårslet (DK); Morten Dremark-Larsen, Silkeborg (DK); Christian Per Bunde-Pedersen, Højbjerg (DK)

(73) Assignee: Johnson Controls Denmark ApS, Højbjerg (DK)

( * ) Notice: Subject to any disclaimer, the term of this patent is extended or adjusted under 35 U.S.C. 154(b) by 13 days.

(21) Appl. No.: 17/576,685

(22) Filed: Jan. 14, 2022

(65) Prior Publication Data

US 2022/0228781 A1 Jul. 21, 2022

(51) Int. Cl.

| | |
|---|---|
| ***F25B 39/00*** | (2006.01) |
| ***F25B 40/06*** | (2006.01) |
| ***F25B 39/02*** | (2006.01) |

(52) U.S. Cl.

CPC ..... *F25B 39/00* (2013.01); *F25B 40/06* (2013.01); *F25B 39/02* (2013.01); *F25B 2339/024* (2013.01)

(58) Field of Classification Search

CPC ..... F25B 39/00; F25B 40/06; F25B 39/02; F25B 2339/024; F25B 39/022; F25B 2400/23; F25B 43/006; F25B 2400/02

(Continued)

(56) References Cited

U.S. PATENT DOCUMENTS 4,009,575 A * 3/1977 Hartman, Jr. ..... F25B 27/00 422/243

9,046,310 B2 6/2015 Joensen et al.

(Continued)

FOREIGN PATENT DOCUMENTS

CN 103591721 A 2/2014
CN 209386624 U 9/2019

(Continued)

OTHER PUBLICATIONS

Danish Search Report and Search Opinion for DK Application No. PA 2021 70023, dated Jul. 14, 2021, 7 pgs.

(Continued)

*Primary Examiner* — Henry T Crenshaw
*Assistant Examiner* — Kamran Tavakoldavani
(74) *Attorney, Agent, or Firm* — Fletcher Yoder, P.C.

(57) ABSTRACT

Disclosed is a refrigerant processing unit (1) for evaporating a refrigerant. The refrigerant processing unit (1) comprises a recirculation container (2) and a refrigerant inlet (3) connected to the recirculation container (2) for leading liquid refrigerant into the recirculation container (2). The refrigerant processing unit (1) also comprises a flooded evaporator heat exchanger (4) arranged to heat the liquid (Continued)

Figure 2:
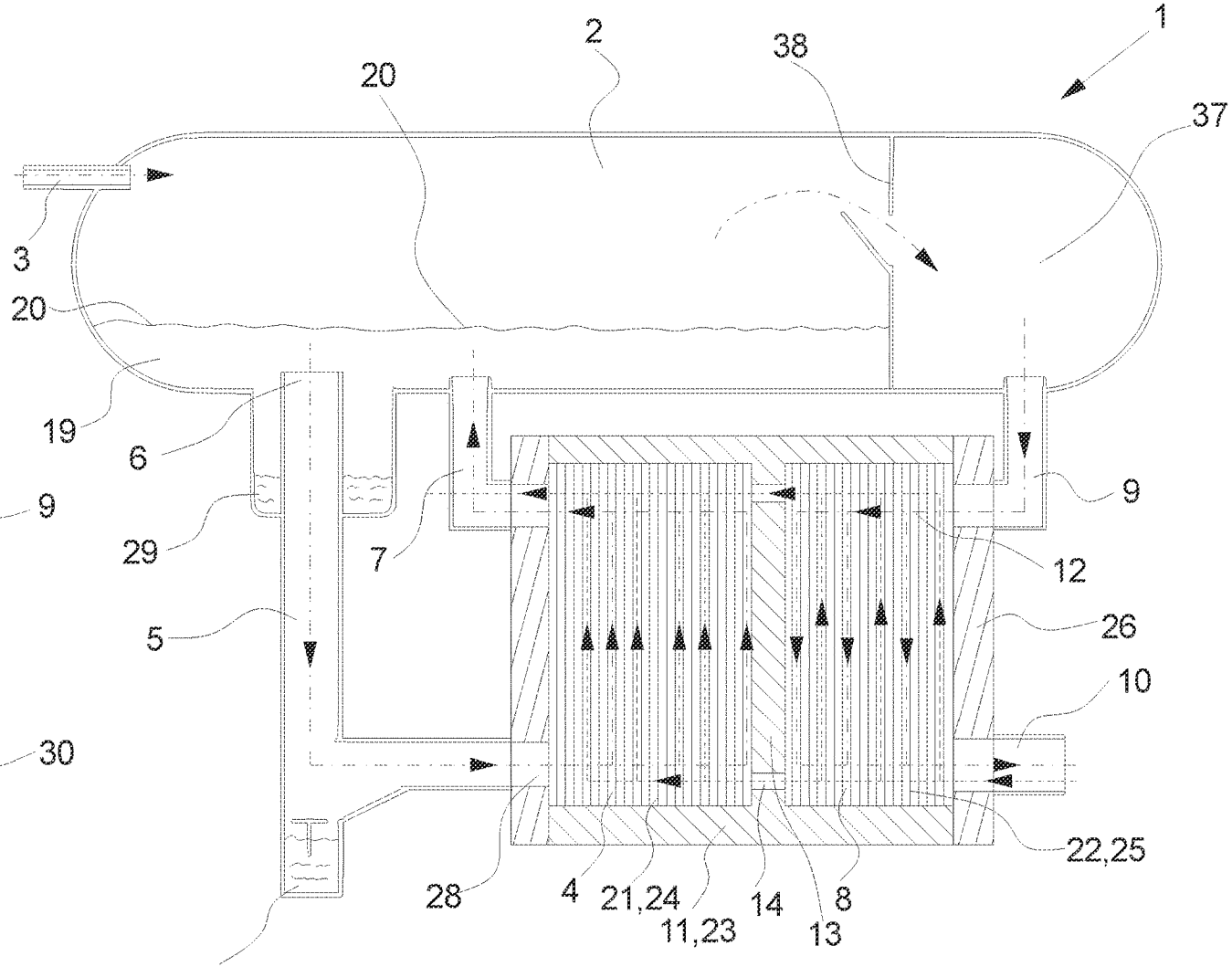

refrigerant to generate a phase change of the refrigerant from a liquid phase to a gaseous phase and a standpipe (5) extending between a liquid refrigerant outlet (6) of the recirculation container (2) and an evaporator inlet (28) of the flooded evaporator heat exchanger (4). Further, the refrigerant processing unit (1) comprises a return pipe (7) arranged to guide gaseous refrigerant from the flooded evaporator heat exchanger (4) back into the recirculation container (2) and a superheater heat exchanger (8) located below the recirculation container (2), wherein the superheater heat exchanger (8) is arranged to heat the gaseous refrigerant to generate a superheated gaseous refrigerant. Furthermore, the refrigerant processing unit (1) comprises a guide pipe (9) arranged to guide gaseous refrigerant from the recirculation container (2) into the superheater heat exchanger (8), and an outlet pipe (10) arranged to guide the superheated gaseous refrigerant out of the superheater heat exchanger (8) and thereby out of the refrigerant processing unit (1), wherein the flooded evaporator heat exchanger (4) and the superheater heat exchanger (8) are formed as a single heat exchanger unit (11) located below the recirculation container (2).

A method for evaporating a refrigerant and use of a refrigerant processing unit (1) is also disclosed.

20 Claims, 3 Drawing Sheets

(58) Field of Classification Search
USPC ..... 62/183
See application file for complete search history.

(56) References Cited

U.S. PATENT DOCUMENTS

| | | | |
|---|---|---|---|
| 2006/0016214 | A1 | 1/2006 | Gorbounov et al. |
| 2012/0279684 | A1 | 11/2012 | Keisling et al. |
| 2013/0118419 | A1 | 5/2013 | Stahlhut et al. |
| 2019/0195573 | A1 | 6/2019 | Yang et al. |

FOREIGN PATENT DOCUMENTS

| | | | |
|---|---|---|---|
| EP | 2834578 | B1 | 3/2016 |
| EP | 3742067 | A1 | 11/2020 |
| GB | 2161256 | A | 1/1986 |
| WO | 2020242289 | A1 | 12/2020 |

OTHER PUBLICATIONS

Hundy G.H.: "Refrigeration, Air Conditioning and Heat Pumps" In: "Refrigeration, Air Conditioning and Heat Pumps", Mar. 7, 2016, 2 pages.

Djordjevic E et al: "Flow Boiling of R134a and Ammonia in A Plate Heat Exchanger", International Journal Of Heat And Mass Transfer, Elsevier, Dec. 1, 2008, pp. 6235-6242, vol. 51 , ISSN: 0017-9310.

Anonymous: "Plate Heat Exchanger Passes And Flow Path—Plate Heat Exchanger Gaskets", WTSL Heat Transfer Technology Co. Ltd. , May 12, 2019, 2 pages, https://www.heatexchangersgasket.com/news/plate-heat-exchanger-passes-and-flow-path-23344413.html.

European Search report for EP Application No. 22151344.3, dated Jun. 1, 2022, 11 pages.

* cited by examiner

REFRIGERANT PROCESSING UNIT, A METHOD FOR EVAPORATING A REFRIGERANT AND USE OF A REFRIGERANT PROCESSING UNIT

CROSS-REFERENCE TO RELATED APPLICATION

This application claims priority from and the benefit of Danish Patent Application No. PA 2021 70023, entitled "A REFRIGERANT PROCESSING UNIT, A METHOD FOR EVAPORATING A REFRIGERANT AND USE OF A REFRIGERANT PROCESSING UNIT," filed Jan. 15, 2021, which is hereby incorporated by reference in its entirety for all purposes.

FIELD OF THE INVENTION

The present invention relates to a refrigerant processing unit for evaporating a refrigerant. The invention further relates to a method for evaporating a refrigerant and use of a refrigerant processing unit.

BACKGROUND OF THE INVENTION

A closed cooling circuit—also called Vapor-compression refrigeration or a vapor-compression refrigeration system (VCRS)—is a circuit in which a refrigerant undergoes phase changes and move heat between a warm side and a cold side. Such circuits can be used for cooling or refrigeration purposes, but the cooling circuit can also be used as a heat pump where heat is absorbed from a cold medium and released to a warmer one.

A closed cooling circuit typically comprises a compressor which compresses the gaseous refrigerant, a condenser in which the heat is transferred to another medium while the refrigerant is condensed to a liquid phase, an evaporator in which the refrigerant is heated to form a gaseous refrigerant which then is lead to the compressor. Fluctuations in load, surrounding temperature or other may lead to liquid refrigerant being led to the compressor—which is inefficient and could be damaging—and it is therefore known to guide the gaseous refrigerant from the evaporator through a superheater to reduce the risk of liquid refrigerant reaching the compressor. However, such a separate superheater is expensive and entails more piping etc.

From GB 2161256 B and EP 2 834 578 B1 it is therefore known to arrange the evaporator and the superheater in the same vessel. But these systems are difficult to control.

It is therefore an object of the present invention to provide for a more simple and cost-efficient refrigerant processing unit design.

The Invention

The invention relates to a refrigerant processing unit for evaporating a refrigerant. The refrigerant processing unit comprises a recirculation container and a refrigerant inlet connected to the recirculation container for leading liquid refrigerant into the recirculation container. The refrigerant processing unit also comprises a flooded evaporator heat exchanger arranged to heat the liquid refrigerant to generate a phase change of the refrigerant from a liquid phase to a gaseous phase and a standpipe extending between a liquid refrigerant outlet of the recirculation container and an evaporator inlet of the flooded evaporator heat exchanger. Further, the refrigerant processing unit comprises a return pipe arranged to guide gaseous refrigerant from the flooded evaporator heat exchanger back into the recirculation container and a superheater heat exchanger located below the recirculation container, wherein the superheater heat exchanger is arranged to heat the gaseous refrigerant to generate a superheated gaseous refrigerant. Furthermore, the refrigerant processing unit comprises a guide pipe arranged to guide gaseous refrigerant from the recirculation container into the superheater heat exchanger, and an outlet pipe arranged to guide the superheated gaseous refrigerant out of the superheater heat exchanger and thereby out of the refrigerant processing unit, wherein the flooded evaporator heat exchanger and the superheater heat exchanger are formed as a single heat exchanger unit located below the recirculation container.

A flooded evaporator is very simple to operate and by placing it below the recirculation container, gravity can be used to collect the liquid refrigerant through a standpipe which together with the recirculation container may act as a system buffer thereby making the refrigerant processing unit less sensitive to variations in load.

Furthermore, by forming the flooded evaporator heat exchanger and the superheater heat exchanger as a single heat exchanger unit located below the recirculation container, a more compact and inexpensive refrigerant processing unit can be formed which requires less piping etc.

It should be noticed, that in this context the term "flooded evaporator heat exchanger" should be understood as a heat exchanger in which the liquid refrigerant is in direct contact with the heating elements (typically plates or tubes) in the heat exchanger through which a secondary heating fluid flows so that the heat exchange happens primarily directly across the heating elements between the liquid refrigerant and the secondary heating fluid—hence the term "flooded".

It should also be noticed, that in this context the term "superheater heat exchanger" should be understood as a heat exchanger in which saturated gaseous refrigerant or wet gaseous refrigerant is heated to form superheated gaseous refrigerant or dry gaseous refrigerant. I.e., in a superheater heat exchanger, the gaseous refrigerant is heated to a temperature well above the dew point of the specific refrigerant at the specific pressure.

Further, it should also be noticed, that in this context the term "leading liquid refrigerant into the recirculation container" should not only be understood as all the refrigerant being liquid. Typically, the refrigerant entering the recirculation container is a mixture of liquid and gaseous refrigerant.

Furthermore, it should be noticed that any reference to orientation throughout this document—i.e. up, down, bottom, upper, top etc.—refers to the orientation during normal use of the refrigerant processing unit.

In an aspect, the single heat exchanger unit is arranged outside the recirculation container.

Arranging the heat exchanger unit outside the recirculation container is advantageous in that it enables easy access during maintenance and repair, and it entails a simpler recirculation container design.

In an aspect, the flooded evaporator heat exchanger and the superheater heat exchanger comprise a common heating fluid conduit extending continuously through the flooded evaporator heat exchanger and the superheater heat exchanger inside the single heat exchanger unit.

Arranging a common heating fluid so that it runs continuously through both the flooded evaporator heat exchanger and the superheater heat exchanger is advantageous in that complicated piping hereby can be avoided, thus reducing cost and simplifying installation.

Furthermore, by first running the heating fluid through the superheater heat exchanger and then through the flooded evaporator heat exchanger, the heating fluid will be hottest in the superheater where a higher temperature is needed to superheat the gaseous refrigerant—which also eliminates the need for active control of the superheated gaseous refrigerant as it is linked directly to the temperature profile of the heating fluid.

In an aspect, the flooded evaporator heat exchanger and the superheater heat exchanger are separated by a separation plate arranged inside the single heat exchanger unit.

Arranging a separation plate between the flooded evaporator heat exchanger and the superheater heat exchanger inside the single heat exchanger unit is advantageous in that the plate will prevent that refrigerant is passed directly from the flooded evaporator heat exchanger and into the superheater heat exchanger, hereby enabling that liquid and gaseous refrigerant can be separated to increase the efficiency and function of the refrigerant processing unit.

Furthermore, arranging a separation plate between the flooded evaporator heat exchanger and the superheater heat exchanger is advantageous in that the plate will ensure that refrigerant is guided correctly from the flooded evaporator heat exchanger, the recirculation container and into the superheater heat exchanger, while at the same time ensuring that liquid refrigerant cannot pass from the flooded evaporator heat exchanger and into the superheater heat exchanger. Hereby is the efficiency of both functions increased.

In an aspect, the separation plate comprises a heating fluid passage opening.

Making separation plate comprise a heating fluid passage opening is advantageous in that the heating fluid hereby can pass from the superheater heat exchanger and into the flooded evaporator heat exchanger inside the heat exchanger unit whereby complicated external piping can be avoided.

In an aspect, the flooded evaporator heat exchanger comprises a first heating fluid conduit and the superheater heat exchanger comprises second heating fluid conduit, wherein the first heating fluid conduit is separate from the second heating fluid conduit.

Forming the first heating fluid conduit inside the flooded evaporator heat exchanger fully separate from the second heating fluid conduit inside the superheater heat exchanger is advantageous in that the flowrate and temperature of the heating fluid thereby can be controlled separately in each of the heat exchangers whereby efficiency of the refrigerant processing unit can be increased.

In an aspect, a cul-de-sac is formed at the bottom of the standpipe.

Forming the bottom of the standpipe as a dead end is advantageous in that such a cul-de-sac enables heavier fluids in the refrigerant—such as oil—to settle in the cul-de-sac in which they are concentrated and can easily be removed. These fluids are thereby prevented from leaving the refrigerant processing unit and additional oil separators and the like can thereby be omitted.

In an aspect, the liquid refrigerant outlet of the recirculation container is arranged at a bottom part of the recirculation container.

Arranging the liquid refrigerant outlet at the bottom part of the recirculation container is advantageous in that this increases the chance of all liquid refrigerant being led from the recirculation container to the evaporator by means of gravity.

In an aspect, the guide pipe is extending up into the recirculation container so that an inlet opening of the guide pipe is above the liquid level of the recirculation container during normal use of the refrigerant processing unit.

Making the guide pipe extend up into the recirculation container to an upper part of the recirculation container is advantageous in that this enables that the gaseous refrigerant can be drawn from the recirculation container without risking liquid refrigerant entering the guide pipe.

In an aspect, evaporator heat exchanging elements of the flooded evaporator heat exchanger and superheater heat exchanging elements of the superheater heat exchanger are arranged inside the same common continuous shell.

Pressure vessels like flooded evaporator heat exchangers and superheater heat exchangers have to be pressure tested and approved by an independent authority before commercial use. This is both complex and expensive. Thus, by arranging the flooded evaporator heat exchanger and the superheater heat exchanger inside the same common continuous shell both functions can be obtained by means of only one test and approval.

Furthermore, by arranging the flooded evaporator heat exchanger and the superheater heat exchanger inside the same common continuous shell, complicated finishing arrangements and piping between them can be avoided hereby reducing cost and simplifying installation. And the overall heat exchanger unit is more compact hereby simplifying installation and increasing usability.

In an aspect, the common continuous shell is formed by two or more connected shell parts.

Forming the shell by two or more connected shell parts is advantageous in that it hereby is possible to subsequently open the shell e.g. in case of maintenance or repair work.

In an aspect of the invention, said shell is cylindrical.

Forming the shell cylindrical is advantageous in that this shape ensure an even distribution of the pressure load on the shell.

In an aspect, the common continuous shell encircles the evaporator heat exchanging elements and superheater heat exchanging elements.

Making the same shell encircle the evaporator heat exchanging elements and the superheater heat exchanging elements is advantageous in that this design ensures a strong and durable shell capable of withstanding high internal pressure.

In an aspect, the evaporator heat exchanging elements are formed by a stack of corrugated evaporator heat exchanger plates and the superheater heat exchanging elements are formed by a stack of corrugated superheater heat exchanger plates.

Forming the heat exchanging elements as corrugated plates is advantageous in that corrugated plates have an increased surface whereby heat transfer is increased.

In an aspect, the corrugated evaporator heat exchanger plates and the corrugated superheater heat exchanger plates are substantially identical.

Forming all the heat exchanger plates inside the heat exchanger unit substantially identical is advantageous in that it reduces production costs and simplifies assembly.

In an aspect, the common continuous shell is formed as a monolithic tube.

Forming the shell as a monolithic tube is advantageous in that it simplifies the manufacturing process and reduces cost, since the shell is a pressure vessel.

In an aspect, the common continuous shell comprises endplates welded to both ends of the shell.

Welding the endplates ensures that the shell—i.e. the pressure vessel—is both strong and tight.

In an aspect, the common continuous shell is a pressure vessel designed and/or approved to withstand a pressure between 0.7 and 15 MPa, preferably between 1.5 and 10 and most preferred between 2.5 and 7.5 MPa.

If the pressure, the shell is designed to withstand, is too low, the risk of leakage or even explosion is too big. However, if the pressure, the shell is designed to withstand, is too high the shell becomes too heavy and expensive. Thus, the present pressure ranges present an advantageous relationship between safety and cost.

Furthermore, the invention relates to method for evaporating a refrigerant. The method comprises the steps of:

- forming a flooded evaporator heat exchanger and a superheater heat exchanger as a single heat exchanger unit,
- locating the single heat exchanger unit below a recirculation container,
- leading liquid refrigerant into the recirculation container,
- leading the liquid refrigerant down into the flooded evaporator heat exchanger via a standpipe,
- heating the liquid refrigerant in the flooded evaporator heat exchanger to generate a phase change of the refrigerant from a liquid phase to a gaseous phase,
- guiding the gaseous refrigerant from the flooded evaporator heat exchanger back into the recirculation container,
- guiding the gaseous refrigerant from the recirculation container into the superheater heat exchanger in which the gaseous refrigerant is further heated to form a superheated gaseous refrigerant, and
- guiding the superheated gaseous refrigerant out of the superheater heat exchanger.

Using a flooded evaporator along with the recirculation container and standpipe ensures that the method is less sensitive to variations load in that the recirculation container and standpipe will act as a system buffer. Furthermore, by guiding the gaseous refrigerant from the flooded evaporator into the superheater heat exchanger through the recirculation container reduces the risk of liquid refrigerant entering the superheater. And by forming the flooded evaporator heat exchanger and the superheater heat exchanger as a single heat exchanger unit placed under the recirculation container is advantageous in that gravity can be used for guiding the liquid refrigerant into the evaporator and in that the single unit makes the system more compact and less complex.

In an aspect, the refrigerant is evaporated and superheated by way of a refrigerant processing unit according to any of the previously discussed refrigerant processing units.

Hereby is achieved an advantageous embodiment of the invention.

The invention also relates to use of a refrigerant processing unit according to any of the previously discussed refrigerant processing units for evaporating and superheating a refrigerant in a closed cooling circuit.

In closed cooling circuits it is particularly important to control the liquid refrigerant level in the condenser to maintain the efficiency of the cooling circuit and it is therefore particularly advantageous to apply the present invention to a closed cooling circuit.

FIGURES

Figure 1:
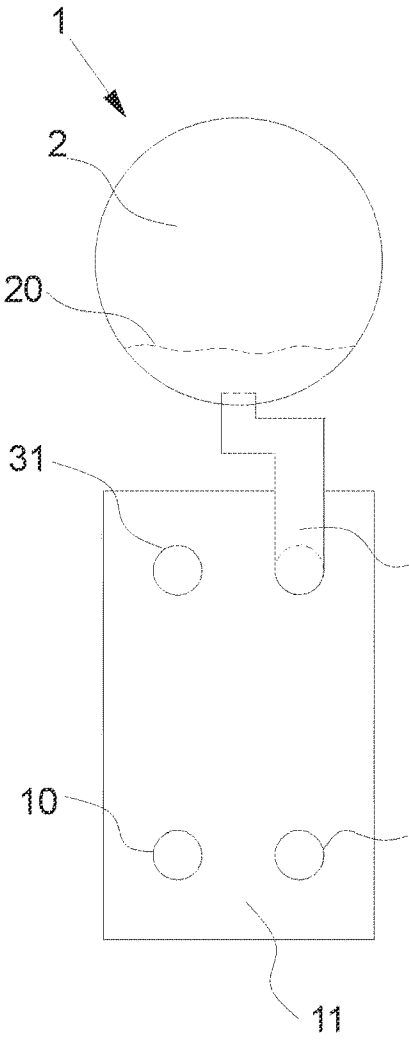
Figure 3:
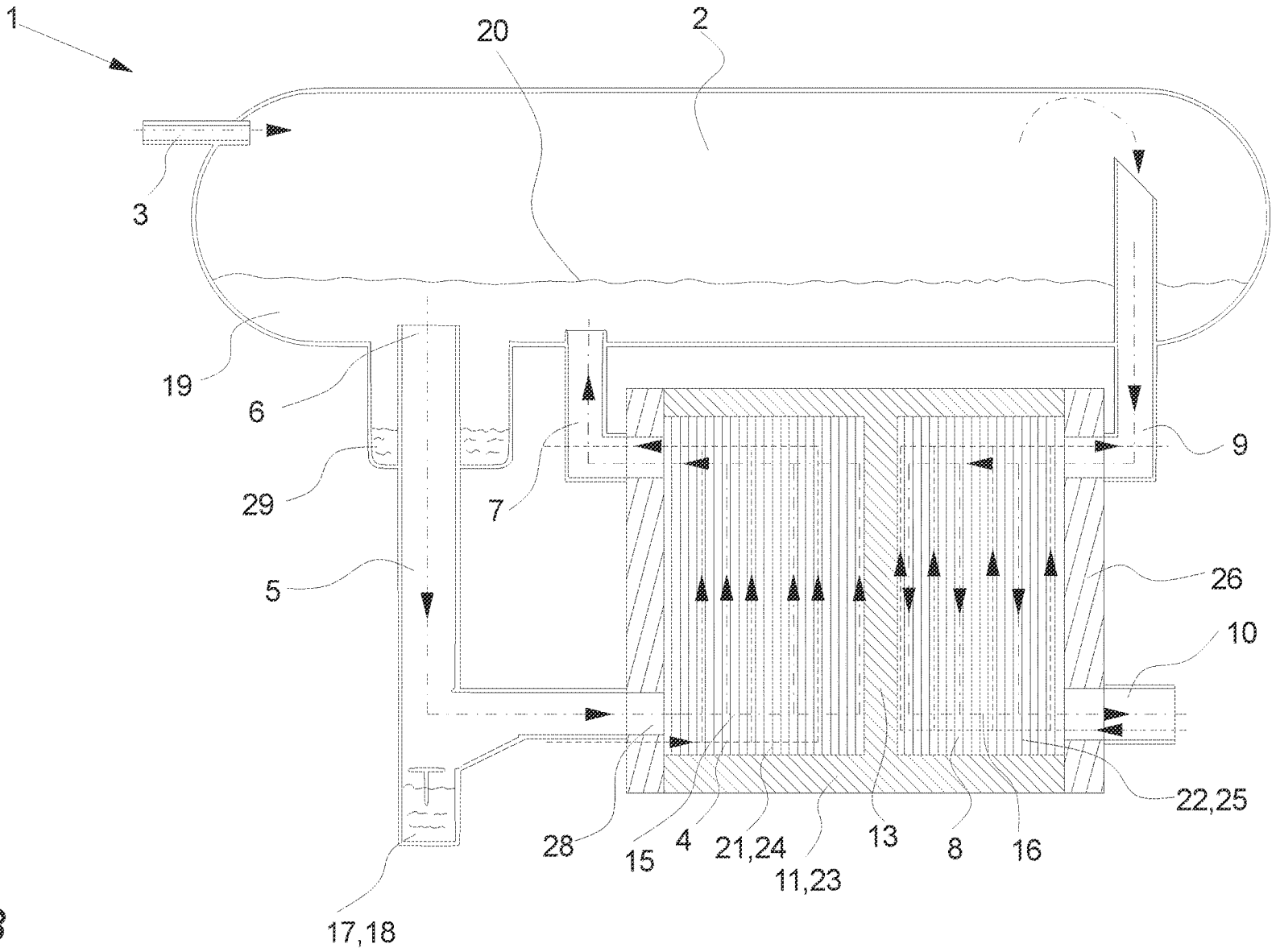
Figure 4:
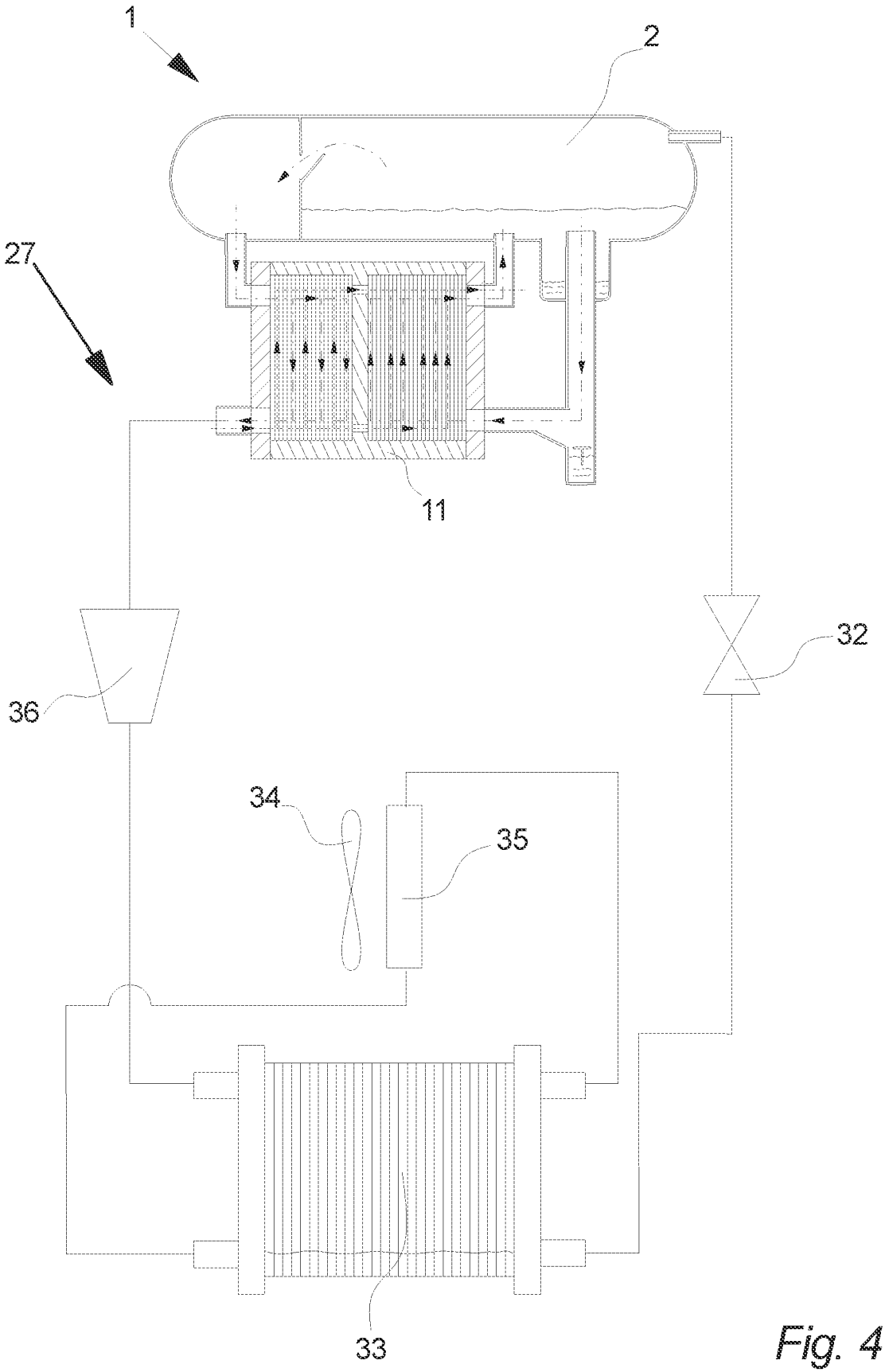

The invention will be explained further herein below with reference to the figures in which:

FIG. 1 shows a simplified embodiment of a refrigerant processing unit, as seen from the side, FIG. 2 shows a cross section through a simplified embodiment of a refrigerant processing unit with a common heating fluid conduit, as seen from the front, FIG. 3 shows a cross section through a simplified embodiment of a refrigerant processing unit with a first heating fluid conduit and a second heating fluid conduit, as seen from the front, and FIG. 4 illustrates an embodiment of a closed cooling circuit.

DETAILED DESCRIPTION

FIG. 1 shows simplified embodiment of a refrigerant processing unit 1, as seen from the side and FIG. 2 shows a cross section through the same refrigerant processing unit 1 with a common heating fluid conduit 12, as seen from the front.

In this embodiment liquid refrigerant or at least a mixture of gaseous and liquid refrigerant is led into the recirculation container 2 through a refrigerant inlet 3 so that it is collected at the bottom 19 of the recirculation container 2. From there the liquid refrigerant flows down into a liquid refrigerant outlet 6, into a standpipe 5 in which it is collected and led further on into the flooded evaporator heat exchanger 4 through the evaporator inlet 28.

In this embodiment the standpipe 5 is a relatively large diameter vertical tube but in another embodiment the standpipe 5 could be any form of pipe, tube, conduit or other connecting the liquid refrigerant outlet 6 with the evaporator inlet 28 and since the flooded evaporator heat exchanger 4 is located below the recirculation container 2 at least some of the standpipe 5 will have to extend downwards. Which will enable the standpipe function of the standpipe 5.

In the flooded evaporator heat exchanger 4 the liquid refrigerant is heated to a temperature above the dew point of the refrigerant to generate a phase change to form gaseous refrigerant. The gaseous refrigerant bubbles up through the flooded evaporator heat exchanger 4 and exits the flooded evaporator heat exchanger 4 through the return pipe 7 through which the saturated gaseous refrigerant enters the recirculation container 2 and bubbles up through any liquid refrigerant at the bottom 19 of the recirculation container 2. From the recirculation container 2 the saturated gaseous refrigerant is guided into a superheater heat exchanger 8 by means of a guide pipe 9. In the superheater heat exchanger 8 the temperature of the saturated gaseous refrigerant is raised to form a superheated gaseous refrigerant which leaves the superheater heat exchanger 8 through an outlet pipe 10.

In this embodiment the flooded evaporator heat exchanger 4 and the superheater heat exchanger 8 are formed as a single heat exchanger unit 11 located below the recirculation container 2 in that in this embodiment both heat exchangers 4, 8 are formed as shell-and-plate heat exchangers 4, 8 where the evaporator heat exchanging elements 21 arranged inside the flooded evaporator heat exchanger 4 and the superheater heat exchanging elements 22 of the superheater heat exchangers 8 are both placed inside the same common continuous shell 23. However, in another embodiment one or both of the heat exchangers 4, 8 could be formed as plate-and-plate heat exchangers, tube-and-shell heat exchangers 4, 8 or another type of heat exchanger. And/or in another embodiment the single heat exchanger unit 11 could be formed without a common continuous shell 23 e.g., in case both heat exchangers 4, 8 were formed as plate-and-plate heat exchangers where the plates of each heat exchanger 4, 8 are separated by a separation plate 13 but the plates of both heat exchangers 4, 8 would be held in place by the same common rigid frame thereby forming a single heat exchanger unit 11.

To separate the flooded evaporator heat exchanger 4 from the superheater heat exchanger 8, a separation plate 13 is in this embodiment arranged between the two. However, in this embodiment the heat exchangers 4, 8 comprise the same common heating fluid conduit 12 through which a secondary heating fluid flows to act as a heat source for first superheating the gaseous refrigerant in the superheater heat exchanger 8 and subsequently also act as a heat source for driving the phase change in the flooded evaporator heat exchanger 4. I.e., in this embodiment the single heat exchanger unit 11 comprises only one common heating fluid conduit 12 extending continuously through the superheater heat exchanger 8 and the flooded evaporator heat exchanger 4 and the separation plate 13 is therefore in this embodiment provided with heating fluid passage openings 14 enabling that the heating fluid may pass from the superheater heat exchanger 8 and into the flooded evaporator heat exchanger 4. It is advantageous to make the heating fluid exchange heat in the superheater heat exchanger 8 first before the heating fluid is guided into the flooded evaporator heat exchanger 4 in that the superheater heat exchanger 8 requires the highest temperature to dry the saturated refrigerant. However, in another embodiment the heating fluid conduit 12 could be arranged differently in the heat exchanger unit 11 so that the flow path of the heating fluid through the heat exchanger unit 11 would be different.

The arrows shown in dash-dot lines on FIGS. 2 (and 3) illustrate the refrigerant flow through the refrigerant processing unit 1 and the arrows shown in dotted lines on FIGS. 2 (and 3) illustrate the heating fluid flow through the heat exchanger unit 11.

In this embodiment the entire heating fluid conduit 12 is arranged inside the shell 23 of the heat exchanger unit 11 but in another embodiment at least parts of the heating fluid conduit 12 could be arranged outside the shell 23 e.g. to pass the separation plate 13 or other.

In the embodiments disclosed in FIGS. 2 and 3 the shell 23 is formed as a single monolithic cylindrical tube comprising endplates 26 welded to both ends of the shell 23 to increase the strength of the shell 23 and reduce the risk of unwanted stress concentrations in the shell 23. Thereby a strong pressure vessel is formed which in this embodiment is approved to withstand a pressure up to 10 MPa. However, in another embodiment the shell 23 could also be formed by a number of shell parts welded together or means of several shell parts bolted together to ensure that the shell 23 subsequently can be opened e.g. in case of maintenance and/or repair.

In this embodiment the evaporator heat exchanging elements 21, the superheater heat exchanging elements 22, the shell 23 and the endplates 26 are all made from stainless steel because of this material's strength and durability but in another embodiment all or some of the heat exchanger unit parts could be made from another material such as titanium, aluminium, a composite material or other.

In this embodiment the recirculation container 2 is provided with a partition wall 38 forming a separation chamber 37 at one end of the recirculation container 2. The partition wall 38 comprises an opening at the top of the recirculation container 2 ensuring that the gaseous refrigerant can flow into the separation chamber 37 and further on into the superheater heat exchanger 8 while blocking the liquid refrigerant collected at the bottom 19 of the recirculation container 2 from entering the superheater heat exchanger 8.

In this embodiment the heating fluid is brine but in another embodiment the heating fluid could be water, ammonia, or another form of natural or artificial heating fluid suitable for flowing exchanging heat with the refrigerant.

In this embodiment the refrigerant is ammonia (ASHRAE number R-717) but in another embodiment the refrigerant could be carbon dioxide, Butane, a HFC, water or another fluid suitable for acting as a refrigerant in a refrigerant processing unit 1.

In this embodiment the refrigerant processing unit 1 is disclosed with only one of each of the elements recirculation container 2, liquid refrigerant outlet 6, standpipe 5, flooded evaporator heat exchanger 4 etc. but in another embodiment the refrigerant processing unit 1 could comprise more than one of one or more of these elements—such as two, three, five or even more—and/or some or all of the elements could be arranged differently both in size, design and location.

In this embodiment the evaporator heat exchanging elements 21 arranged inside the flooded evaporator heat exchanger 4 are corrugated evaporator heat exchanging plates 24 and the superheater heat exchanging elements 22 of the superheater heat exchangers 8 are corrugated superheater heat exchanging plates 25 but in another embodiment the evaporator heat exchanging element 21 and/or the superheater heat exchanging elements 22 could also or instead be different types of plates, they could be formed as tubes or any combination thereof.

In this embodiment the corrugated evaporator heat exchanging plates 24 and the corrugated superheater heat exchanging plates 25 are substantially identical to reduce production cost and simplifying assembly but in another embodiment the plates 24, 25 could be designed different e.g. for their specific use, for their specific location in the heat exchanger unit 11, for specific temperatures or other making the design of the plates 24, 25 in the heat exchanger unit 11 vary.

FIG. 3 shows a cross section through a simplified embodiment of a refrigerant processing unit 1 with a first heating fluid conduit 15 and a second heating fluid conduit 16, as seen from the front.

In the embodiment the heat exchanger unit 11 does not comprise a common heating fluid conduit 12. Instead the flooded evaporator heat exchanger 4 comprises its own first heating fluid conduit 15 and the superheater heat exchanger 8 comprises its own second heating fluid conduit 16, wherein the first heating fluid conduit 15 and the second heating fluid conduit 16 are separate from each other to e.g. ensure better individual temperature control.

In this embodiment the recirculation container 2 does not comprise a partition wall 38 or a separation chamber 37. Instead, the guide pipe 9 is arranged to extend up into the recirculation container 2 so that an inlet opening of the guide pipe 9 is above the liquid level 20 in the recirculation container 2 during normal use of the refrigerant processing unit 1 so that only gaseous refrigerant is led into the guide pipe 9. I.e., in this embodiment the inlet opening of the guide pipe 9 is arranged at an upper part of the recirculation container 2.

In this embodiment a cul-de-sac 17 is formed at the bottom 18 of the standpipe 5 and a collection zone 29 is formed around the standpipe 5 at the bottom part 19 of the recirculation container 2. Both the cul-de-sac 17 and the collection zone 29 are arranged to collect fluids that that are heavier than the refrigerant—i.e., such as oil—and thereby separate the heavier fluids from refrigerant. The heavier fluids can then be drained from the cul-de-sac 17 and the collection zone 29 by means of a drainage tap (not shown) or by similar means. However, in another embodiment the heavier fluids could be separated out in another location in the refrigerant processing unit 1 and/or the heavier fluids could be separated out by other means such as a dedicated oil separator, a demister device or other. Or in another embodiment the refrigerant processing unit 1 would not comprise means for separating heavier fluids from refrigerant.

FIG. 4 illustrates an embodiment of a closed cooling circuit 27 comprising a refrigerant processing unit 1 according to the present invention.

In this embodiment the refrigerant processing unit 1 according to the present invention is used for evaporating and superheating a refrigerant in a closed cooling circuit. I.e. in this embodiment the superheated gaseous refrigerant leaving the heat exchanger unit 11 is directed through a compressor 36 compressing the gaseous refrigerant, which in turn raises its temperature drastically. The hot gaseous refrigerant is then lead to a condenser 33 where the gaseous refrigerant is condensed into a liquid refrigerant. In some embodiments the gaseous refrigerant could be led through a desuperheater (not shown) where the gaseous refrigerant temperature is lowered to just above the condensation temperature before it enters the condenser 33 and/or in some embodiments the liquid refrigerant could be cooled further in a subcooler (not shown) after leaving the condenser 33. After the cold liquid refrigerant leaves the condenser 33 it is in this embodiment directed to an expansion valve 32, which will reduce the pressure making at least some of the refrigerant evaporate and thus making its temperature drop drastically. At this stage the cold refrigerant is then used for cooling purposes. The refrigerant is then led to the refrigerant processing unit 1 in which the refrigerant is evaporated entirely and heated to form superheated steam in the heat exchanger unit 11 before the cycle is repeated.

In this embodiment the coolant exchanging heat with the refrigerant in the condenser 33 is circulated through a radiator 35 in which it is cooled by a fan 34 passing cold air through the radiator 35. However, it would be obvious to the skilled person that the coolant in another embodiment could be cooled in numerous other ways. In an embodiment the heating fluid exchanging heat with the refrigerant in the heat exchanger unit 11 could be heated in a similar way.

The differences between the refrigerant and the heating fluid flowing through the heat exchanger unit 11, are that the refrigerant is always circulating in a closed circuit in which it changes phase from one state of matter to another (between gas and liquid form) at least twice during circulation, while the heating fluid's main purpose is to heat the refrigerant in the heat exchanger unit 11.

In the foregoing, the invention is described in relation to specific embodiments of recirculation containers 2, heat exchanger units 11, cooling circuits 27 and other as shown in the drawings, but it is readily understood by a person skilled in the art that the invention can be varied in numerous ways within the scope of the appended claims.

LIST

1. Refrigerant processing unit
2. Recirculation container
3. Refrigerant inlet
4. Flooded evaporator heat exchanger
5. Standpipe
6. Liquid refrigerant outlet
7. Return pipe
8. Superheater heat exchanger
9. Guide pipe
10. Outlet pipe
11. Heat exchanger unit
12. Common heating fluid conduit
13. Separation plate
14. Heating fluid passage opening
15. First heating fluid conduit
16. Second heating fluid conduit
17. Cul-de-sac
18. Bottom of standpipe
19. Bottom part of recirculation container
20. Liquid level in recirculation container
21. Evaporator heat exchanging elements
22. Superheater heat exchanging elements
23. Common continuous shell
24. Corrugated evaporator heat exchanger plates
25. Corrugated superheater heat exchanger plates
26. Endplate
27. Closed cooling circuit
28. Evaporator inlet
29. Collection zone
30. Heating fluid inlet
31. Heating fluid outlet
32. Expansion valve
33. Condenser
34. Fan
35. Radiator
36. Compressor
37. Separation chamber
38. Partition wall

The invention claimed is:

1. A refrigerant processing unit for evaporating a refrigerant, the refrigerant processing unit comprising:

a recirculation container;

a refrigerant inlet connected the recirculation container for leading liquid refrigerant into the recirculation container;

a flooded evaporator heat exchanger arranged to heat the liquid refrigerant to generate a phase change of the refrigerant from a liquid phase to a gaseous phase;

a standpipe extending between a liquid refrigerant outlet of the recirculation container and an evaporator inlet of the flooded evaporator heat exchanger;

a return pipe arranged to guide gaseous refrigerant from the flooded evaporator heat exchanger back into the recirculation container;

a superheater heat exchanger located below the recirculation container, wherein the superheater heat exchanger is arranged to heat the gaseous refrigerant to generate a superheated gaseous refrigerant;

a guide pipe arranged to guide the gaseous refrigerant from the recirculation container into the superheater heat exchanger; and an outlet pipe arranged to guide the superheated gaseous refrigerant out of the superheater heat exchanger and thereby out of the refrigerant processing unit, wherein the flooded evaporator heat exchanger and the superheater heat exchanger are formed as a single heat exchanger unit located below the recirculation container.

2. The refrigerant processing unit according to claim 1, wherein the single heat exchanger unit is arranged outside the recirculation container.

3. The refrigerant processing unit according to claim 1, wherein the flooded evaporator heat exchanger and the superheater heat exchanger comprise a common heating fluid conduit extending continuously through the flooded evaporator heat exchanger and the superheater heat exchanger inside the single heat exchanger unit.

4. The refrigerant processing unit according to claim 1, wherein the flooded evaporator heat exchanger and the superheater heat exchanger are separated by a separation plate arranged inside the single heat exchanger unit.

5. The refrigerant processing unit according to claim 4, wherein the separation plate comprises a heating fluid passage opening.

6. The refrigerant processing unit according to claim 1, wherein the flooded evaporator heat exchanger comprises a first heating fluid conduit and the superheater heat exchanger comprises a second heating fluid conduit, wherein the first heating fluid conduit is separate from the second heating fluid conduit.

7. The refrigerant processing unit according to claim 1, wherein a cul-de-sac is formed at a bottom of the standpipe.

8. The refrigerant processing unit according to claim 1, wherein the liquid refrigerant outlet of the recirculation container is arranged at a bottom part of the recirculation container.

9. The refrigerant processing unit according to claim 1, wherein the guide pipe is extending up into the recirculation container so that an inlet opening of the guide pipe is above a liquid level of the recirculation container during normal use of the refrigerant processing unit.

10. The refrigerant processing unit according to claim 1, wherein evaporator heat exchanging elements of the flooded evaporator heat exchanger and superheater heat exchanging elements of the superheater heat exchanger are arranged inside a common continuous shell.

11. The refrigerant processing unit according to claim 10, wherein the common continuous shell encircles the evaporator heat exchanging elements and the superheater heat exchanging elements.

12. The refrigerant processing unit according to claim 10, wherein the evaporator heat exchanging elements are formed by a stack of corrugated evaporator heat exchanger plates and wherein the superheater heat exchanging elements are formed by a stack of corrugated superheater heat exchanger plates.

13. The refrigerant processing unit according to claim 12, wherein the stack of corrugated evaporator heat exchanger plates and the stack of corrugated superheater heat exchanger plates are substantially identical.

14. The refrigerant processing unit according to claim 10, wherein the common continuous shell is formed as a monolithic tube.

15. The refrigerant processing unit according to claim 10, wherein the common continuous shell comprises endplates welded to both ends of the common continuous shell.

16. The refrigerant processing unit according to claim 10, wherein the common continuous shell is a pressure vessel designed and/or approved to withstand a pressure between 0.7 and 15 MPa.

17. The refrigerant processing unit according to claim 10, wherein the common continuous shell is a pressure vessel designed and/or approved to withstand a pressure between 1.5 and 10 MPa.

18. The refrigerant processing unit according to claim 10, wherein the common continuous shell is a pressure vessel designed and/or approved to withstand a pressure between 2.5 and 7.5 MPa.

19. A method, comprising:

using of a refrigerant processing unit according to claim 1 for evaporating and superheating a refrigerant in a closed cooling circuit.

20. A method for evaporating a refrigerant, wherein the method comprises the steps of forming a flooded evaporator heat exchanger and a superheater heat exchanger as a single heat exchanger unit;

locating the single heat exchanger unit below a recirculation container;

leading liquid refrigerant into the recirculation container;

leading the liquid refrigerant down into the flooded evaporator heat exchanger via a standpipe;

heating the liquid refrigerant in the flooded evaporator heat exchanger to generate a phase change of the refrigerant from a liquid phase to a gaseous phase;

guiding gaseous refrigerant from the flooded evaporator heat exchanger back into the recirculation container;

guiding the gaseous refrigerant from the recirculation container into the superheater heat exchanger in which the gaseous refrigerant is further heated to form a superheated gaseous refrigerant; and guiding the superheated gaseous refrigerant out of the superheater heat exchanger.

* * * * *